United States Patent [19]

Littleton

[11] 4,249,345

[45] Feb. 10, 1981

[54] RELEASABLE WINDOW GUARD

[76] Inventor: Ricky V. Littleton, 1401 N. Rogers, Irving, Tex. 75061

[21] Appl. No.: 69,634

[22] Filed: Aug. 27, 1979

[51] Int. Cl.[3] ..... E06B 3/68

[52] U.S. Cl. ..... 49/56; 49/395; 49/141

[58] Field of Search ..... 49/56, 50, 57, 394, 49/395, 67, 141; 160/159-161

[56] References Cited

U.S. PATENT DOCUMENTS

| | | | |
|---|---|---|---|
| 2,924,862 | 2/1960 | Pellicore | 49/56 |
| 3,087,750 | 4/1963 | Kelly | 49/56 X |
| 3,417,805 | 12/1968 | Kaufman et al. | 160/161 X |
| 3,506,056 | 4/1970 | Quinones et al. | 160/160 |
| 3,953,939 | 5/1976 | Klein | 49/56 |
| 4,059,923 | 11/1977 | Sauer | 49/57 |
| 4,070,048 | 1/1978 | Young | 49/57 X |
| 4,111,472 | 9/1978 | Smith et al. | 49/56 X |

*Primary Examiner*—Philip C. Kannan

*Attorney, Agent, or Firm*—James E. Bradley

[57] ABSTRACT

A window guard assembly has features that allow it to be released from the inside to allow occupants to escape in case of fire. The window guard assembly also has features that prevent the locking mechanism from being actuated by an intruder on the outside of the building. The guard assembly has a guard mounted to a window frame for covering a window. The guard is pivotally mounted, and a locking mechanism selectively prevents the pivoting of the guard. A latch member controls the locking mechanism. An enclosure is formed around the latch member to prevent access from the exterior. The enclosure has an opening that faces the interior. A pair of doors are located at the opening, one with a vertical hinge, and the other with a horizontal hinge. Both of these doors require opening to reach the latch member. When opened, the doors form a barrier in cooperation with the window frame that requires the intruder to attempt to reach around the doors in order to reach the latch member.

11 Claims, 5 Drawing Figures

11
15c
13
19
15b
23a 51
39b
53
65
63
39a
15d
39c
23a
31
37
29
35
19
27
15a 25
39b
59
53
61
57
55
33
39d
63
39e
23d
39c
23a
31
37
19
27
21
15a 25
39b
59
35
53
61
55
57
29
33
39d
63
39e
23d
39c

RELEASABLE WINDOW GUARD

BACKGROUND OF THE INVENTION

1. Field of the Invention

This invention relates in general to security guards for windows and in particular to a guard that can be opened from the inside but not the outside.

2. Description of the Prior Art

Most window guards comprise a grate or grid of bars secured over the window opening to prevent intruders. Should a fire occur, occupants may be trapped inside because of inability to remove the guard. Consequently, there are several patents disclosing guards that are releasable to allow escape such as U.S. Pat. Nos. 2,924,862; 3,953,939; 4,059,923; 4,070,048; and 4,111,472. U.S. Pat. No. 4,059,923, requires a key to unlock the guard. The key could be misplaced. The other patents disclose locking mechanisms that do not require a key. In the types using wire mesh grates this may be satisfactory, but with parallel bar guards, it appears that an intruder could reach through the bars and actuate the latch if he broke or opened the window.

SUMMARY OF THE INVENTION

It is accordingly a general object of this invention to provide an improved window guard.

It is a further object of this invention to provide an improved window guard that is releasable from the inside, but cannot be released from the outside.

It is a further object of this invention to provide an improved window guard that is releasable only from the inside, and cannot be released by one on the outside even if an intruder breaks or opens the window.

In accordance with these objects, a window guard assembly is provided of the type having a guard comprised of bars for covering a window. The guard has attachment means for pivotally mounting it to the window frame to allow opening and closing movement. Locking means selectively prevents the opening movement. The locking means has a manually actuable latch member that controls it.

An enclosure is constructed around the latch member to prevent access from the exterior. The enclosure has an opening facing the interior of the building. A pair of doors are mounted to the opening, one with a vertical hinge and the other with a horizontal hinge. Both doors are the full size of the opening, requiring both of them to be opened to reach the latch member inside the enclosure. Opening both doors creates a barrier that requires one to reach around the doors in an attempt to reach the latch member. The doors are of a size to prevent this occurrence.

DESCRIPTION OF THE PREFERRED EMBODIMENT

Figure 1:
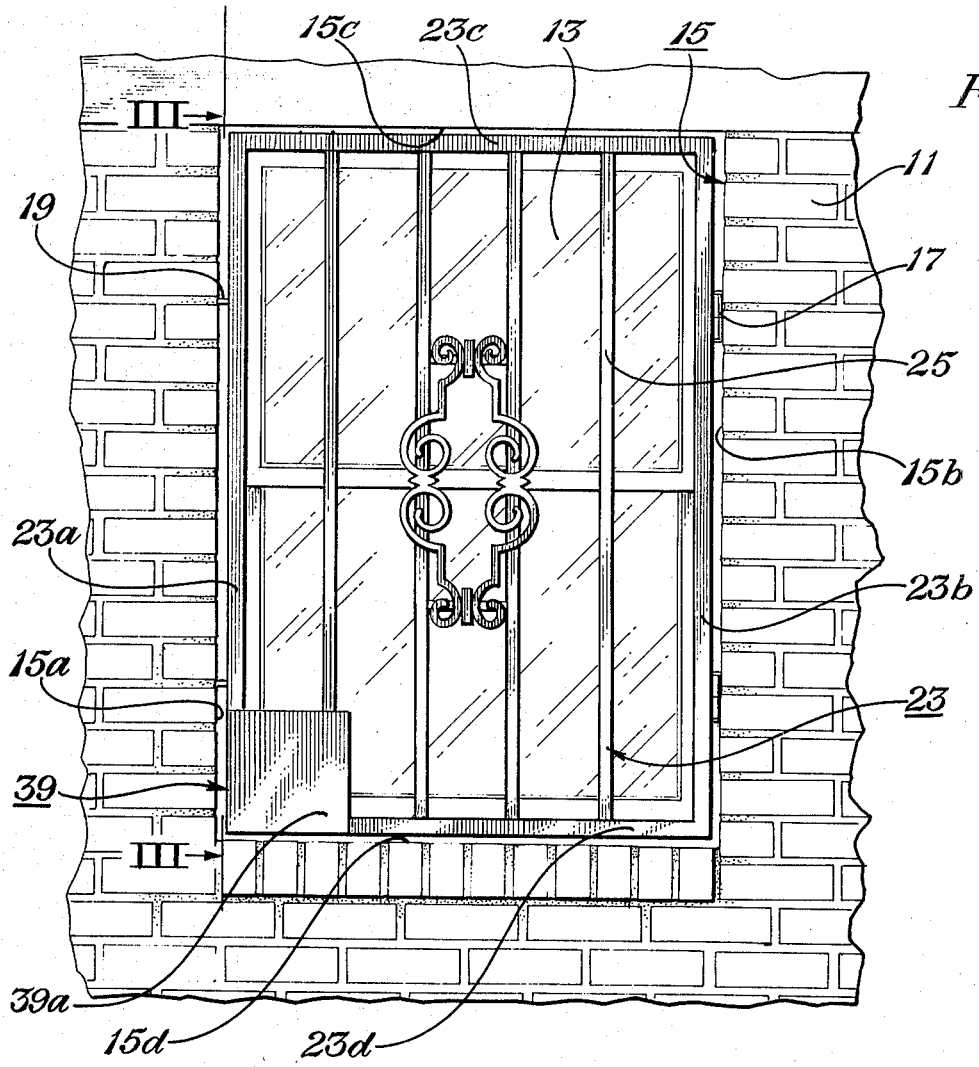
FIG. 1 is a front elevational view of a building having a window guard assembly constructed in accordance with this invention.
Figures 3, 4, 5:
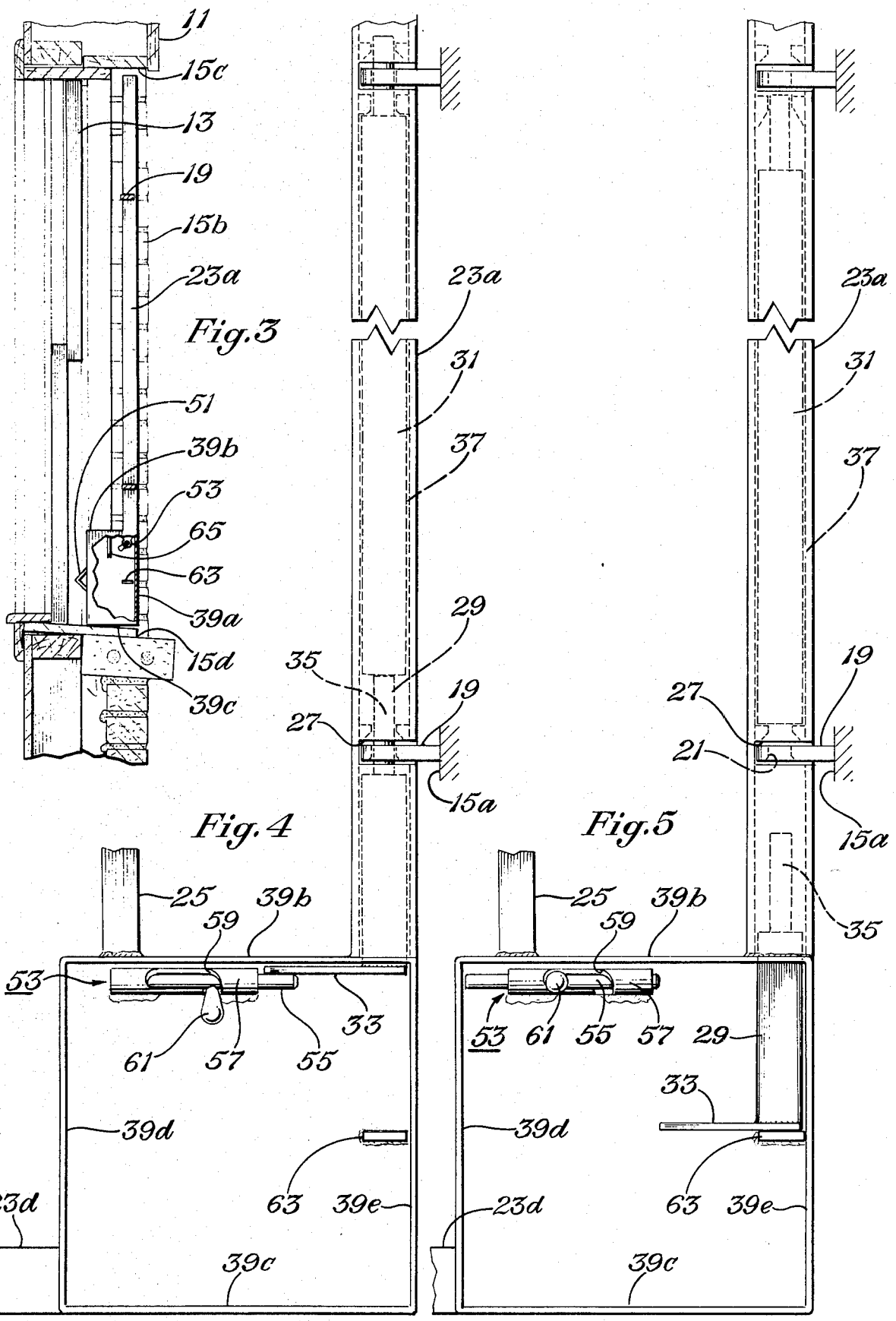
FIG. 3 is a cross-sectional view of the window guard assembly of FIG. 1 taken along the lines III—III of FIG. 1, partially broken away.
FIG. 4 is a cross-sectional view of the window guard assembly of FIG. 1 taken along the lines IV–IV, with the locking means shown in the closed position.
FIG. 5 is a cross-sectional view similar to FIG. 4 with the locking means shown in the open position.

Referring to FIG. 1 a building 11 having a window 13 is shown. Window 13 is mounted in a rectangular window frame 15 that has two vertical members 15*a* and 15*b* and top and bottom horizontal members 15*c* and 15*d*. A pair of hinges 17 are mounted to vertical frame member 15*b*. A pair of tabs 19 are spaced apart from each other and mounted to vertical member 15*a*. As shown in FIGS. 4 and 5, each tab comprises a small rectangular strip of metal, with a vertical hole 21 (FIG. 5) therethrough.

The window guard assembly includes a guard 23 comprised of parallel tubes or bars. The guard 23 has a rectangular frame of slightly smaller dimensions than the window frame 15. Guard 23 includes two vertical members 23*a* and 23*b* and top and bottom horizontal members 23*c* and 23*d*. Vertical parallel bars 25 extend between the top and bottom members 23*c* and 23*d*, parallel with the vertical members 23*a* and 23*b*. Hinges 17 are secured to vertical member 23*b* to allow it to swing or pivot outwardly from window 13.

Figure 2:
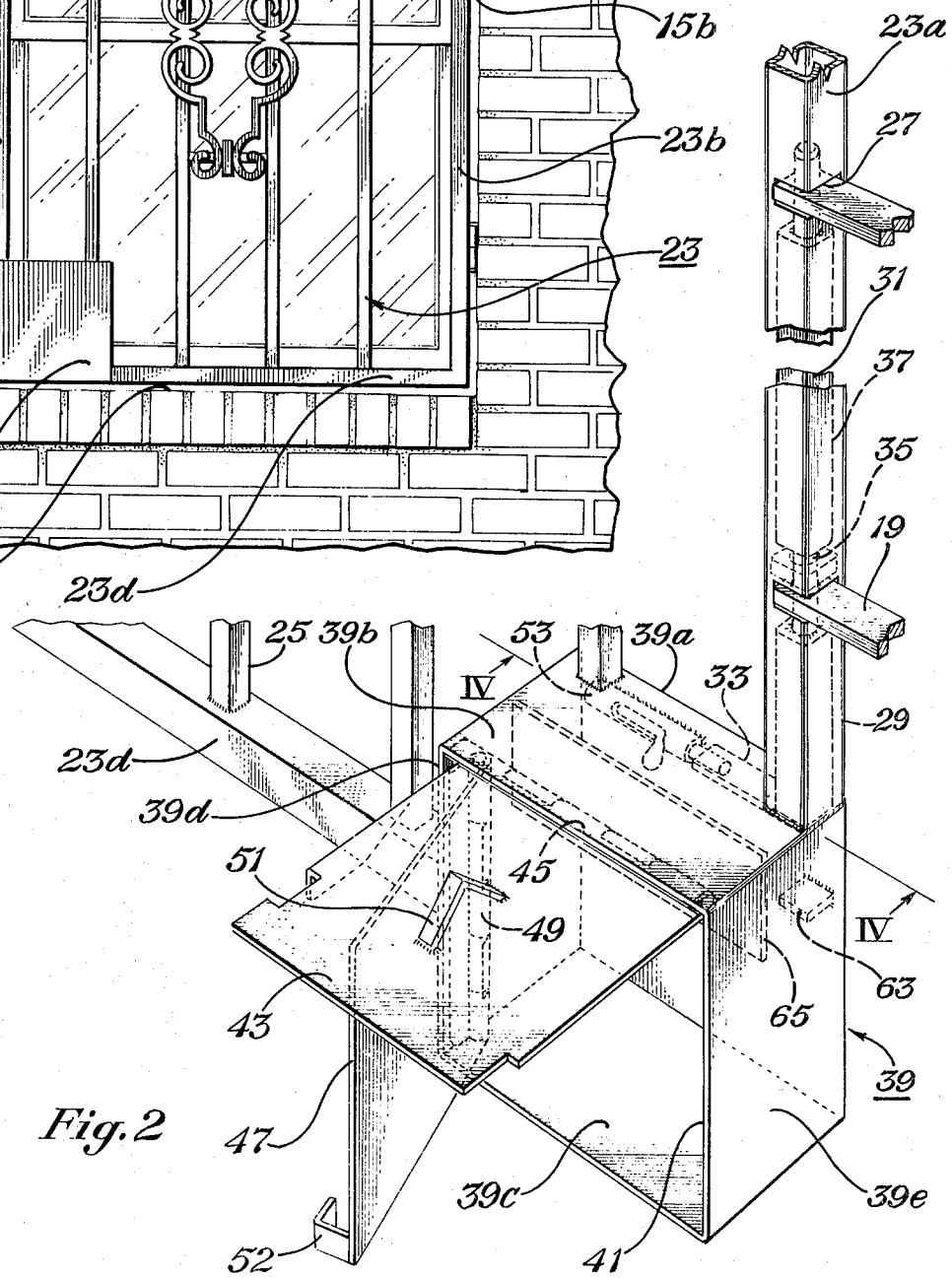
FIG. 2 is a partial perspective view of a portion of the window guard assembly of FIG. 1.

As shown in FIG. 2, vertical frame member 23*a* is hollow and has a pair of spaced apart slots 27. The slots 27 have a height slightly greater than the thickness of the flat tabs 19 and are spaced apart for receiving tabs 19. A pair of rods 29 and 31 are carried slidably and coaxially in the hollow rectangular bar 23*a*. Referring also to FIGS. 4 and 5, lower rod 29 has a lateral extension member 33 secured to its bottom or base. Extension member 33 is a flat strip, perpendicular to rod 29 and extending toward the other vertical frame member 23*b*. Rod 29 is adapted to extend through hole 21 in the lower tab 19. Rod 31 is mounted above the lowe slot 27.

Each rod 29, 31 has a lower rectangular tubular portion 37 and an upper cylindrical rod portion 35. The rod portion 35 of lower rod 29 will extend through the lower slot 27 and bump the solid bottom of the rectangular portion 37 of the upper rod 31. The lower slot 27 has a circular opening through which the upper rod's rectangular portion 37 is unable to pass. Rods 29 and 31 are of lengths selected so that when the rod 29 is moved into the upper position, its cylindrical portion 35 extends through the hole 21 in the lower tab 19 and also pushes the rectangular portion 37 of upper rod 31 upward. This causes the cylindrical portion 35 of the upper rod 31 to extend through the hole 21 in the upper tab 19. In the open position, lower rod 29 drops below the lower slot 27, and upper rod 31 drops below the upper slot 27, with its rectangular portion 37 resting on the upper circular opening of the lower slot 27.

An enclosure or box 39 is formed in the lower corner of guard 23 at the intersection of vertical member 23*a* with bottom member 23*d*. Box 39 is rectangular with six solid metal sides. The back 39*a* is vertical plane surface, parallel and flush with the plane of guard 23. The top 39*b* and bottom 39*c* are parallel with each other, horizontally oriented, and perpendicular to the back 39*a*. Bottom 39*c* is flush with the bottom or base of bottom frame member 23*d*. The sides 39*d* and 39*e* are parallel with each other, vertically oriented and perpendicular to the back 39*a*, top 39*b* and bottom 39*c*. Side 39*e* is flush with vertical frame member 23*a*. Top and bottom 39*b* and 39*c* and vertical sides 39*d* and 39*e* are all of the same dimension, defining an enclosure between guard 23 and window 13. The front side of enclosure 39 is an opening 41 facing into the interior of building 11.

A first door 43 is mounted to the top 39*b* at its inner edge with a horizontal hinge 45. Hinge 45 allows door 43 to move between a closed position in which it is in a vertical plane parallel with back 39*a* to a horizontal position, parallel with top 39*b*, as shown in FIG. 2. A second door 47 is mounted to the enclosure vertical side 39*d* a short distance from the inner edge by a vertical hinge 49. Hinge 49 allows door 47 to move between a closed position in which it is parallel with back 39*a* to an open position parallel with side 39*d*. In the open position, the inner side of door 47 faces the nearest window frame vertical member 15*a*. Doors 43 and 47 are both substantially the same size as and fit tightly within opening 41. A handle 51 on door 43 facilitates its opening. A handle 52 on door 47 facilitates its opening.

Referring to FIGS. 4 and 5, a latch member 53 is mounted to the inner side of back 39*a* near the top. Latch member 53 comprises a bolt 55 horizontally mounted in a cylindrical slide 57. Slide 57 contains an aperture 59 through which a handle 61 secured to bolt 55 protrudes. In the closed position, shown in FIG. 4, bolt 55 is located below extension member 33 to prevent rods 29 and 31 from falling downward. In the open position, shown in FIG. 5, bolt 55 retracts sufficiently to allow rods 29 and 31 to fall downward. A stop 63 secured to the inner side of back 39*a* of the enclosure limits the amount of downward travel of rods 29 and 31. Stop 63 is located about midway along the height of the enclosure 39.

Referring to FIGS. 2 and 3, a partition 65 is mounted to the inner side of top 39*b* and extends downwardly about one-fourth the height of the enclosure 39. Partition 65 is parallel with back 39*a* and located about midway between back 39*a* and door 47. Partition 65 extends completely across the width of enclosure 39 and serves to restrict access to the latch member 53.

In operation, the guard 23 is installed on the outside of a window 13 by mounting hinges 17 and tabs 19 to the window frame 15. Preferably, the hinges 17 and tabs 19 are placed sufficiently close to window 15 so that doors 43 and 47 cannot be opened unless the window 13 is raised or broken. To lock the window guard, the latch member 53 should be in the open position, as shown in FIG. 5, with rod 29 resting on stop 63. This allows the frame member 23*a* to be positioned so that tabs 19 are located in slots 27. Then, from the inside, the rod 29 is pushed upward. Its cylindrical portion 35 proceeds through the hole 21 in the lower tab 19 and pushes rod 31 upward until the cylindrical portion 35 of rod 31 engages the hole 21 in the upper tab 19. This position, which is shown in FIG. 4, locates the extension member 33 at the top of enclosure 39. Then handle 61 of the bolt 55 is moved to the right to restrain the rods 29 and 31 in the upper, closed position. Doors 43 and 47 are closed after the guard 23 has been locked.

To unlock the guard 23, the occupant inside the building raises the window 13, then opens doors 43 and 47 for access to the latch member 53. The occupant must reach under partition 65 to contact handle 61 of the bolt 65 with his fingers. He slides the bolt 55 to the left, allowing rods 29 and 31 to drop by gravity to the position shown in FIG. 5. This releases guard 23, allowing it to be swung outward on its hinges 17. Should an intruder attempt to unlock the window guard from the outside of the building, he must first break or raise the window 13 to open the doors 43 and 47. The doors 43 and 47 serve along with the window frame members 15*a* and 15*d* to define a barrier. As shown in the drawing, the intruder cannot reach between window frame member 15*d* and bottom 39*c* nor window frame member 15*a* and enclosure side 39*e*. He would have to reach around the doors 43 and 47, then under partition 65 in order to contact the latch member 53. The size of the doors 43 and 47, and the depth of the enclosure 39, however, is selected so that this is virtually impossible to perform.

Hinges 17 serve as attachment means for pivotally mounting the guard 23 to the window frame. Tabs 19, slots 27, rods 29 and 31, extension member 33 and latch member 53 serve as locking means for selectively preventing opening movement of the guard 23. Enclosure 39 serves as enclosure means for surrounding the latch member 53 to prevent access to the latch member from the exterior of the building. In the preferred embodiment, the enclosure 39 is about three and one half inches deep and six inches in width and height. The rectangular portion 35 and the cylindrical portion 37 of rods 29 and 31 serve along with the circular opening of lower slot 27 as limit means for preventing the upper rod 31 from dropping into the lower slot 27, but allowing the lower rod 29 to push the upper rod 31 into the upper slot 27.

It should be apparent that an invention having significant advantages has been provided. The window guard assembly has the advantage of being quickly releasable from the inside, but not from the outside, even if the window is opened or broken.

While the invention has been shown in only one of its forms, it should be apparent to those skilled in the art that it is not so limited, but is susceptible to various changes and modifications without departing from the spirit thereof. For example, the enclosure 39 could be fixably mounted to the window frame 15, with the guard 23 swinging into and latching with it. Also, the bottom 39*c* and side 39*e* could be deleted, since they are in closed proximity to the window frame members 15*a* and 15*d*. These frame members could serve as a part of the enclosure means for preventing access to the latch member.

I claim:

1. An improved window guard assembly of the type having a guard for covering a building window, attachment means for pivotally mounting the guard to a window frame to allow opening and closing movement, and locking means for selectively preventing opening movement, the locking means including a manually actuable latch member for controlling the locking means, the improvement comprising:

enclosure means for surrounding the latch member to prevent access to the latch member from the exterior of the building, the enclosure means having an opening facing the interior of the building for providing access to the latch member from inside the building;

and a plurality of doors hingedly mounted to the enclosure means for covering the opening, the doors being of a size that requires all of the doors to be opened to provide access to the latch member, the doors being positioned in relation to each other so that in the open position, they define a barrier that requires one on the exterior of the building to reach around the doors in an attempt to reach the latch member.

2. An improved releasable window guard assembly of the type having a guard for covering a building window, attachment means for pivotally mounting the guard to a window frame to allow opening and closing movement, and locking means for selectively preventing opening movement, the locking means including a manually actuable latch member for controlling the locking means, the improvement comprising:

enclosure means adapted to be located at one corner of the window frame for surrounding the latch member to prevent access to the latch member from the exterior of the building, the enclosure means having an opening facing the interior of the building for providing access to the latch member from inside the building;

a first door connected to the enclosure means opening by a horizontally oriented hinge; and a second door connected to the enclosure means opening by a vertically oriented hinge, both doors substantially covering the enclosure means opening so as to require both doors to be opened for access to the latch member, the hinges being located so that the doors combine with the window frame to define a barrier that requires one on the exterior of the building to attempt to reach around the doors in order to contact the latch member.

3. The window guard assembly according to claim 2 wherein the enclosure means comprises a rectangular box mounted to a lower corner of the guard.

4. The window guard assembly according to claim 3 wherein a partition is mounted between the doors and the latch member inside the box, the partition extending vertically a portion of the height of the box, requiring one to reach past the partition in order to contact the latch member.

5. The window guard assembly according to claim 2 wherein the attachment means comprises a plurality of hinges mounted between the grid and the window frame on one vertical side.

6. The window guard assembly according to claim 5 wherein the locking means comprises:

a tab secured to the window frame on the side opposite the hinges, the tab having a hole therethrough; and a rod slidably carried on one side of the guard and adapted to extend through the hole in the tab;

the latch member being located in the enclosure means below the rod for selectively preventing vertical sliding movement of the rod.

7. A releasable window guard assembly for mounting in a window frame, comprising in combination:

a guard having two vertical spaced apart members;

a pair of hinges connected to one of the vertical members for securing the guard to the window frame;

the other vertical member being hollow and having a horizontal slot intermediate its ends;

a tab adapted to be mounted to the window frame for reception in the slot when the guard is closed, the tab having a hole therethrough;

a rod slidably carried in the hollow vertical member and adapted to extend through the hole in the tab;

a latch member slidably mounted to the guard below the slot, the latch member being movable between a closed position in which it holds the rod in engagement with the tab and an open position in which the rod is allowed to fall past the latch member and disengage itself from the tab;

enclosure means for enclosing the latch member to prevent access to the latch member from the exterior of the building, the enclosure means having an opening facing the interior of the building for providing access to the latch member from inside the building;

a first door connected to the enclosure means opening by a horizontally oriented hinge at the top of the first door;

a second door connected to the enclosure means opening by a vertically oriented hinge, the vertical hinge being spaced from the hollow vertical member so that when the second door opens, its inner side faces the nearest vertical side of the window frame, the doors and opening being of a size that requires both doors to be opened to reach the latch member.

8. The window guard assembly according to claim 7 wherein the enclosure means comprises:

a rectangular box having a solid back, top and bottom, and solid vertical sides, one of the vertical sides being flush with the hollow vertical member, the bottom being flush with the base of the guard, the front of the box being the opening.

9. The window guard assembly according to claim 8 wherein the latch member comprises a sliding bolt mounted to the inner side of the back of the box.

10. The window guard assembly according to claim 8 further comprising a partition extending downwardly a selected distance from the inner side of the top of the box between the doors and the latch member.

11. The window guard assembly according to claim 7 further comprising:

an upper slot in the hollow vertical member spaced vertically from said slot;

an upper tab having a hole therethrough mounted to the window frame and spaced vertically from said tab;

an upper rod slidably carried in the hollow vertical member above said rod; and limit means between the upper slot and said slot for preventing the upper rod from dropping through said slot, but allowing said rod to push the upper rod through the hole in the upper tab.

* * * * *